US007858956B2

(12) United States Patent
Treichel et al.

(10) Patent No.: US 7,858,956 B2
(45) Date of Patent: Dec. 28, 2010

(54) UV IRRADIATION UNIT FOR SUBSTRATES

(75) Inventors: Oliver Treichel, Stuttgart (DE); Klaus Ebinger, Wernau (DE); Joachim Jung, Nürtingen (DE); Stefan Jung, legal representative, Neckarhausen (DE); Melanie Niemann, nee Jung, legal representative, Ossweil (DE); Carsten Jung, legal representative, Neckarhausen (DE); Günter Fuchs, Unterlenningen (DE)

(73) Assignee: IST Metz GmbH, Nürtingen (DE)

( * ) Notice: Subject to any disclaimer, the term of this patent is extended or adjusted under 35 U.S.C. 154(b) by 277 days.

(21) Appl. No.: 11/659,550

(22) PCT Filed: Jul. 19, 2005

(86) PCT No.: PCT/EP2005/007836

§ 371 (c)(1),
(2), (4) Date: Aug. 1, 2007

(87) PCT Pub. No.: WO2006/015694

PCT Pub. Date: Feb. 16, 2006

(65) Prior Publication Data

US 2008/0277600 A1 Nov. 13, 2008

(30) Foreign Application Priority Data

Aug. 6, 2004 (DE) ..... 10 2004 038 592

(51) Int. Cl.
*G21K 5/00* (2006.01)
*G21K 5/02* (2006.01)

(52) U.S. Cl. ..... 250/504 R; 250/493.1; 250/492.1; 359/350

(58) Field of Classification Search ..... 422/105, 422/186, 187, 300, 24, 82.05, 186.3, 20, 422/306; 250/455.11, 453.11, 454.11, 428, 250/431, 432 R, 434, 435, 436, 437, 438, 250/493.1, 504 R, 504 H, 494.1, 498.1, 505.1, 250/492.2, 454.44, 429, 496.1, 503.1, 492.1; 356/51; 359/350, 355, 359, 361; 362/84, 362/217.01, 218, 225, 217.02, 217.05
See application file for complete search history.

(56) References Cited

U.S. PATENT DOCUMENTS 4,242,725 A * 12/1980 Douma et al. ..... 362/341

(Continued)

FOREIGN PATENT DOCUMENTS

DE 103 33 664 A1 2/2005

(Continued)

OTHER PUBLICATIONS

International Search Report.

*Primary Examiner*—Jack I Berman
*Assistant Examiner*—Nicole Ippolito Rausch
(74) *Attorney, Agent, or Firm*—Collard & Roe, P.C.

(57) ABSTRACT

The invention relates to an irradiation unit for the UV irradiation of particularly web-shaped substrates, comprising a housing (10), a tubular UV lamp (12), arranged therein and a reflector arrangement (14), running along the UV lamp (12). According to the invention, a simple exchangeability may be achieved, whereby the reflector arrangement comprises a support profile (22), retained in the housing (10) and a reflector profile (24), embodied as a shape-retaining molded piece which may be detachably connected thereto.

17 Claims, 1 Drawing Sheet

U.S. PATENT DOCUMENTS

Figure 1:
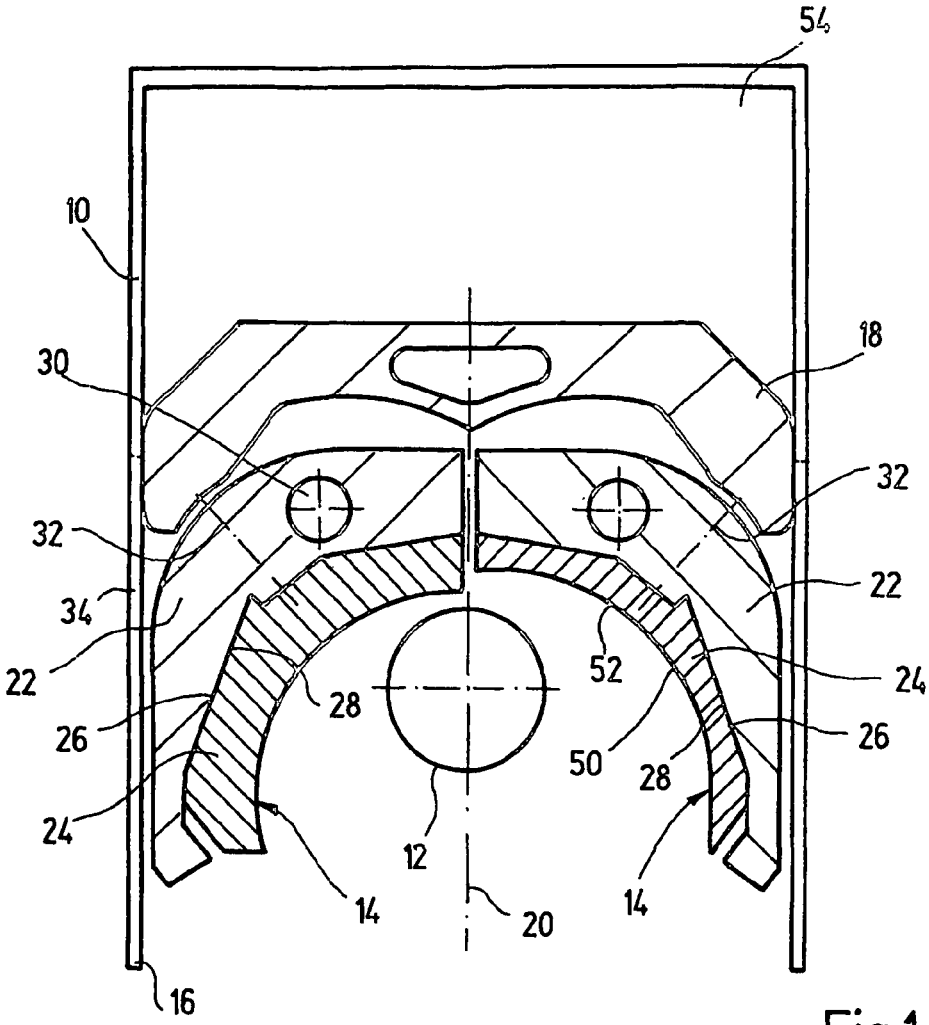

| | | | | |
|---|---|---|---|---|
| 5,150,253 | A | 9/1992 | Watanuki et al. | |
| 5,321,595 | A | 6/1994 | Jacobi et al. | |
| 5,342,582 | A * | 8/1994 | Horn et al. | 422/105 |
| 5,440,137 | A * | 8/1995 | Sowers | 250/504 R |
| 5,444,576 | A | 8/1995 | Shimada et al. | |
| 5,779,855 | A | 7/1998 | Amo et al. | |
| 5,861,633 | A * | 1/1999 | Mandellos | 250/504 R |
| 6,035,548 | A * | 3/2000 | Rae | 34/274 |
| 6,118,130 | A | 9/2000 | Barry et al. | |
| 6,190,609 | B1 * | 2/2001 | Chapman et al. | 422/24 |
| 6,242,717 | B1 | 6/2001 | Sanderson | |
| 6,621,087 | B1 | 9/2003 | Bisges et al. | |
| 2002/0008214 | A1 * | 1/2002 | Sevack et al. | 250/504 R |
| 2004/0037081 | A1 | 2/2004 | Blandford | |
| 2008/0224066 | A1 * | 9/2008 | Nolen et al. | 250/436 |

FOREIGN PATENT DOCUMENTS

| | | | |
|---|---|---|---|
| EP | 1 098 153 | A | 5/2001 |
| GB | 678 789 | A | 9/1952 |
| GB | 2 169 391 | A | 7/1986 |
| GB | 2 349 684 | A | 11/2000 |
| WO | WO 03/021173 | A | 3/2003 |

* cited by examiner

UV IRRADIATION UNIT FOR SUBSTRATES

CROSS REFERENCE TO RELATED APPLICATIONS

Applicants claim priority under 35 U.S.C. §119 of German Application No. 10 2004 038 592.0 filed Aug. 6, 2004. Applicants also claim priority under 35 U.S.C. §365 of PCT/EP2005/007836 filed Jul. 19, 2005. The international application under PCT article 21(2) was not published in English.

The invention relates to an irradiation unit for UV irradiation of substrates, particularly those in web form, having a housing, a rod-shaped UV lamp disposed therein, and a reflector arrangement that extends along the UV lamp.

UV drying and cross-linking of varnishes, paints, and adhesives, utilizing the energy content of light quantums in the UV light spectrum, using elongated medium-pressure gas discharge lamps, has experienced broad industrial use in the printing, packaging, and surface industry for over 30 years. The main characteristics of this technology are freedom from solvents during the process, and the ability to achieve great cross-linking densities with processing times of fractions of a second during a pass-through. Medium-pressure gas discharge lamps emit light from short-wave UV through the visible spectrum all the way to long-wave IR. The effect of the reflector in such UV units cannot be underestimated. Depending on the shape and geometry, its share of the total emission acting on the substrate amounts to 50 to 90%. In the case of selective reflection, the ratio of UV light to IR heat component can also be controlled. In this connection, it has already been proposed to firmly clamp flexible metal strips onto the housing as a reflector. It is felt to be a disadvantage in this connection that in this way, it is not possible to adapt a specific reflector geometry in simple manner. Furthermore, it appears questionable whether such designs can prove themselves in continuous industrial operation, under great temperature stress.

Proceeding from this, the invention is based on the task of improving a unit of the type indicated initially, to the effect that the disadvantages that occur in the state of the art are avoided, and variable use is possible.

To accomplish this task, the combination of characteristics indicated in claim 1 is proposed. Advantageous embodiments and further developments of the invention are evident from the dependent claims.

Accordingly, it is proposed, according to the invention, that the reflector arrangement has a support profile held in the housing and a reflector profile configured as a molded part having a stable shape, which can be releasably connected with the former profile and is therefore interchangeable. In this way, a modular structure is created, in simple manner, which makes it possible to optimally adapt the irradiation profile to the process conditions, in each instance. By means of the use of profile bodies, a defined geometry is set over the length of the lamp, which geometry can be coordinated, even over the short term, with regard to various parameters such as the chemical formulation of the coating agent to be hardened, the heat introduction into the substrate that is still acceptable, and the irradiation period or dose, by means of its interchangeability. In this connection, the correct designs are frequently determined only after comprehensive experiments. This can certainly take place just before or even during start-up, for example in the printing system, on site. Costly risks are avoided by the variability in the reflector geometry. Changes in the product or the coating chemistry can be selectively taken into account by means of the selection of the suitable reflector profile. In this connection, a high thermal resistance is guaranteed by means of the use of solid profiles. Furthermore, the reflector profiles are easily accessible for maintenance or cleaning.

It is advantageous if several reflector profiles having different reflector geometries and/or surface coatings can be optionally connected with the support profile as a modular system, whereby simple assembly is guaranteed by means of uniform connection surfaces, independent of the reflector geometry.

A further improvement provides that the reflector profile and the support profile can be brought into whole-area heat conduction contact with one another by way of connection surfaces having a shape fit. In this connection, it is advantageous if the reflector profile and the support profile are held in surface contact with one another by way of connection means, particularly screw connections.

A simplification of assembly results from the fact that the connection means can be activated from the back of the support profile, which faces away from the reflector profile. It is also advantageous if the connection means are accessible from the outside of the housing, through housing flaps that can be closed, for example.

A further advantageous embodiment provides that the connection means allow thermal equalization play between reflector profile and support profile, seen in the profile direction, preferably by way of an oblong hole mounting.

In a structurally advantageous implementation, the connection means are formed by screw bolts that can be screwed into the reflector profile on the shaft side, preferably all the way to contact, and are supported on the support profile, preferably by way of spring washers and/or slide washers, on the head side.

It is advantageous if the support profile can have coolant applied to it by means of a cooling system, particularly a water cooling system. This can be implemented in that the support profile is provided with profile channels for conducting coolant through. In this way, it is also possible to interchange the reflectors within a short period of time, without interrupting the cooling system.

By means of appropriate wall thicknesses, it is possible that the reflector profile has a curved reflector surface, facing away from its connection surface with the support profile and deviating from the contour progression of this surface. Therefore, the connection surface can be configured uniformly, for standardized accommodation, while the reflector surface is selectively adapted to the irradiation conditions.

In order to allow a spectral influence as well, it is advantageous if the reflector profile is provided with a reflection coating on its profile side that faces the UV lamp.

For great resistance to stress, i.e. strength, it is advantageous if the reflector profile is formed as a solid body from a solid material. In terms of production technology, it is advantageous in this connection if the reflector profile and the support profile preferably consist of aluminum, as extruded profile parts.

A further simplification, also with regard to the apparatuses required for the reflector coating, results from the fact that several reflector profiles are brought together at their faces, as a profile train. In this connection, it should be guaranteed that the abutment points, which can have a lower reflection value, are offset from one another and do not lie opposite one another, in the case of a reflector arrangement in pairs.

To improve the heat transfer, it can be advantageous if a heat conduction means, particularly heat conduction paste, is introduced between the connection surfaces of reflector profile and support profile.

It is advantageous if a support profile and a related reflector profile, in each instance, are disposed in pairs on both sides of a longitudinal center plane of the UV lamp. For a closure function of the housing opening through which radiation passes, it is possible that two reflector profiles together with their related support profiles are disposed in the housing so as to pivot relative to one another about an axis that runs in the profile direction, in each instance.

In the following, the invention will be explained in greater detail using an exemplary embodiment shown schematically in the drawing. This shows:

FIG. 1 a UV irradiation unit for drying printed webs, in cross-section; and

Figure 2:
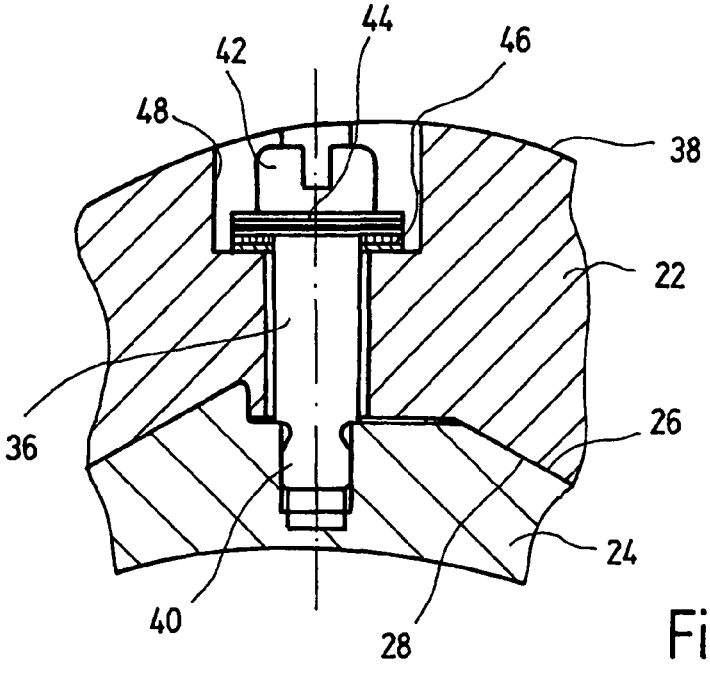

FIG. 2 a detail of an enlargement of a screw connection in the region of the reflector arrangement of the unit according to FIG. 1.

The UV irradiation unit shown in the drawing consists essentially of a box-shaped housing 10, a rod-shaped UV lamp 12 disposed therein, a reflector arrangement 14 for reflection of the UV light emitted into the housing 10 onto a housing opening 16 on the bottom, and an absorber 18 for carrying away waste heat, by way of a cooling device, not shown.

The UV lamp 12, as a medium-pressure gas discharge lamp, is disposed in the center longitudinal plane 20 of the housing 10, and gives off its radiation by way of the housing opening 16, onto the substrate web passed by underneath the latter, i.e. onto the object to be irradiated. In order to increase the irradiation of the object, the UV lamp 12 is surrounded by the reflector arrangement 14, over its length, in its sector that faces into the housing interior, whereby the reflected light is emitted through the housing opening 16 in divergent, parallel, or bundled manner, depending on the reflector geometry. It is also possible that different reflector geometries are implemented in partial reflector regions.

For optional adjustment of the reflector properties, the reflector arrangement 14 consists of support profiles 22 and reflector profiles 24 releasably connected with them. The support and reflector profiles are disposed in pairs on both sides of the longitudinal center plane 20 of the housing 10, i.e. the UV lamp 12, whereby the profile direction runs parallel to the lamp axis. They consist of aluminum, as solid extruded profile parts, so that the reflector profiles 24, in particular, are configured with a stable shape, as molded parts having a complex shape. In this connection, it is possible to use different reflector profiles 24 in the manner of a modular system. In FIG. 1, for the purpose of a better illustration, this is shown for two reflector geometries on the left and on the right of the center plane 20, whereby in practical use, parts having the same profile are generally disposed with mirror symmetry, but fundamentally, asymmetrical arrangements are also possible.

The reflector profiles 24 and support profiles 22 can be brought into large-area heat conduction contact by way of connection surfaces 26, 28 having complementary shapes, with shape fit. For effective heat removal, the support profiles 22 can be connected with the cooling device by way of profile channels 30 for passing cooling water through. In this way, it is possible to work with high lamp powers in the range of several 10 kW.

The support profile 22 and the reflector profile 24 are held in contact with one another in the region of the connection surfaces 26, 28, by way of screw connections 32. In order to simplify the assembly, or the replacement of reflectors, at the site of use, for example in a printing machine, it is practical if the screw connections 32 are accessible from the outside of the housing, by way of housing flaps 34.

As shown in FIG. 2, the screw connections 32 are formed by standing bolts 36 that can be screwed into the reflector profile 24 on the back, from the back 38 of the support profile 22. In the connected state, the standing bolts 36 are screwed into the reflector profile 24 with their stepped threaded shaft 40 making contact. In this connection, the screw head 42 is supported on the support profile 22 by way of plate springs 44 and slide washers 46, with a defined force closure. In order to allow thermal equalization play, the step perforation 48 is configured as an oblong hole, seen in the profile direction.

Because of the freely formable profile geometry, the reflector surface 50 of the reflector profiles 24 that faces the UV lamp 12 can be structured independent of the profile contour of the connection surface 26. Elliptical, parabolic, and circular reflector geometries are used, as are combinations thereof. Reflector surfaces 50 with free-line shapes are also possible.

The spectral range of the reflected light can be influenced by means of an additional surface coating 52 of the reflector profiles 24. Pure aluminum surfaces reflect the entire spectrum, while so-called cold-light mirror coatings reflect only selected spectral bandwidths in the UV range, depending on their embodiment. In this connection, the heat absorbed in the reflector arrangement 14 can be passed away also by means of an air cooling system, with suction through the exhaust air channel 54, in addition to the water cooling system.

The UV and IR emission of the gas discharge lamp 12 cannot be spontaneously turned on and shut off, for physical reasons. Therefore it is provided to bring the reflector arrangement 14 into a standby position during start-up or in the case of interruptions in operation, in which the housing opening 16 is mechanically closed to prevent passage of radiation. For this purpose, the support profiles can be moved, relative to one another, about a pivoting axis or axis of rotation that runs parallel to the profile direction, whereby the IR power is absorbed by the cooled absorber 18. It is possible to switch from this position into the production mode, without any noteworthy loss of time, by means of activating the flipping or rotation mechanism. Instead of a movable reflector, the use of a separate closure system is also possible.

The invention claimed is:

1. An irradiation unit for UV irradiation of substrates, having a box-shaped housing, a rod-shaped UV lamp disposed therein, and a reflector arrangement that extends along the UV lamp, wherein the reflector arrangement has a support profile held in the housing and at least one reflector profile selected from a plurality of reflector profiles having along respective reflective surfaces at least one of different reflector geometries and different surface coatings, wherein the at least one reflector profile is connected with the support profile as a modular system, wherein each reflector profile of the plurality of reflector profiles is configured as a molded part having a stable shape, has an elongated body with a uniform cross-section over an entire length of the reflector profile, and can be releasably connected with the support profile by way of a first uniform connection surface on a backside of the reflector profile, the first uniform connection surface facing away from the reflector surface of the reflector profile and having a shape fit over a large area with a second uniform connection surface of the support profile, wherein a first shape of the first uniform connection surface is independent of the reflector geometry and is complementary to a second shape of the second uniform connection surface, and wherein the support profile is held in reciprocal surface contact with the respective reflector profile by way of connection means.

2. The irradiation unit according to claim 1, wherein the at least one reflector profile and the support profile can be brought into whole-area heat conduction contact with one another.

3. The irradiation unit according to claim 1, wherein the at least one reflector profile and the support profile are held in surface contact with one another.

4. The irradiation unit according to claim 3, wherein the connection means can be activated from the back of the support profile, which faces away from the at least one reflector profile.

5. The irradiation unit according to claim 3, wherein the connection means are accessible from the outside of the housing, through housing flaps that can be closed.

6. The irradiation unit according to claim 3, wherein the connection means allow thermal equalization play between the at least one reflector profile and the support profile, seen in the profile direction.

7. The irradiation unit according to claim 6, wherein the connection means are formed by screw bolts that can be screwed into the reflector profile on the shaft side, and are supported on the support profile on the head side.

8. The irradiation unit according to claim 1, wherein a coolant can be applied to the support profile by means of a cooling system.

9. The irradiation unit according to claim 1, wherein the support profile is provided with profile channels for conducting coolant through.

10. The irradiation unit according to claim 1, wherein the reflector surface of the at least one reflector profile is curved and deviates from the contour progression of the first uniform connection surface.

11. The irradiation unit according to claim 1, wherein the at least one reflector profile is provided with a reflection coating on its profile side that faces the UV lamp.

12. The irradiation unit according to claim 1, wherein the at least one reflector profile is formed as a solid body from a solid material.

13. The irradiation unit according to claim 1, wherein the at least one reflector profile and the support profile comprises aluminum, as extruded profile parts.

14. The irradiation unit according to claim 1, wherein the support profile and the at least one reflector profile form a first profile pair and wherein the irradiation unit comprises a second profile pair, said second profile pair comprising a second support profile and a second reflector profile selected from the plurality of reflector profiles, and wherein the at least one reflector profile and the second reflector profile were provided with a reflector coating by bringing the at least one reflector profile and the second reflector profile together at their faces, as a profile train.

15. The irradiation unit according to claim 14, wherein the support profile and the at least one reflector profile are disposed on a first side of a longitudinal center plane of the UV lamp and the second support profile and the second reflector profile are disposed on a second side of the longitudinal plane opposite the first side.

16. The irradiation unit according to claim 14, wherein the at least one reflector profile and the second reflector profile together with the support profile and the second support profile, respectively, are disposed in the housing so as to pivot relative to one another about an axis that runs in the profile direction, in each instance.

17. The irradiation unit according to claim 1, wherein a heat conduction paste is introduced between the first uniform connection surface of the at least one reflector profile and the second uniform connection surface of the support profile.

* * * * *